United States Patent [19]

Iwama

[11] Patent Number: 4,811,503

[45] Date of Patent: Mar. 14, 1989

[54] SKI BOOT

[75] Inventor: Shinichi Iwama, Sayama, Japan

[73] Assignee: Daiwa Seiko, Inc., Tokyo, Japan

[21] Appl. No.: 18,332

[22] Filed: Feb. 24, 1987

[30] Foreign Application Priority Data

| | | | |
|---|---|---|---|
| Oct. 22, 1986 | [JP] | Japan | 61-161931[U] |
| Oct. 30, 1986 | [JP] | Japan | 61-166842[U] |
| Nov. 15, 1986 | [JP] | Japan | 61-175925[U] |

[51] Int. Cl.[4] ..... A43B 5/04; A43C 11/00

[52] U.S. Cl. ..... 36/119; 36/50

[58] Field of Search ..... 36/117–121, 36/50, 115; 24/68 SK, 69 SK, 70 SK, 71 SK

[56] References Cited

U.S. PATENT DOCUMENTS

| | | | |
|---|---|---|---|
| 4,160,332 | 7/1979 | Salomon | 36/119 |
| 4,196,530 | 4/1980 | Delery | 36/119 |
| 4,654,985 | 4/1987 | Chalmers | 36/50 |
| 4,711,042 | 12/1987 | Morell et al. | 36/50 |
| 4,757,621 | 7/1988 | Iwama | 36/119 |

FOREIGN PATENT DOCUMENTS

| | | | |
|---|---|---|---|
| 3524792 | 1/1986 | Fed. Rep. of Germany | 36/119 |
| 2564711 | 11/1985 | France | 36/119 |
| 634727 | 2/1983 | Switzerland | 36/119 |

*Primary Examiner*—James Kee Chi

*Attorney, Agent, or Firm*—Kalish & Gilster

[57] ABSTRACT

A ski boot having an outer shell which contains a front cuff with opposed side portions, a rear cuff and with inner boot having an instep portion being fitted within the outer shell. First and second elongated continuous flexible members each having forward and rearward end portions are provided for maintaining the boot in snug relationship upon the users foot. The first end portions of said members are fixedly secured upon the boot and are then arranged in mutually crossing relationship across the foot of the wearer and with the rearward end portions of said members being engaged to opposite ends of a boot fastener member provided on the rear portion of the outer shell. The ski boot may, in lieu of having first and second members, have a single member which is suitably directed for extending across the toe and/or instep portion of the inner boot and being secured at its opposite ends to the boot fastener. There may also be guide elements fixed to various parts of the boot structure for directing the flexible member, or members as the case may be between their points of fixed securement for direction intersectingly over the front part of the foot of the inner boot.

17 Claims, 7 Drawing Sheets

SKI BOOT

BACKGROUND AND SUMMARY OF THE INVENTION

The present invention relates to a ski boot having an outer shell and an inner boot member fitted thereinto. More particularly, the present invention pertains to a ski boot having a foot tightening mechanism designed to enable the ankle and the instep to be effectively held at the same time.

There has heretofore been known one type of ski boot which comprises an outer shell and an inner boot member together with a tightening mechanism designed to secure the skier's foot. Examples of this type of ski boot are disclosed in U.S. Pat. No. 4,160,332 (Japenese Patent Laid-Open No. 118360/1977 hereinafter referred to as "first prior art") and the specification of Japanese Patent Laid-Open No. 109502/1986 (hereinafter referred to as "second prior art").

The foot tightening mechanism of the ski boot disclosed in the first prior art is described as follows: A pressing member is disposed at the front portion of the ankle of an inner boot member which is fitted in an outer shell, and one end of a cable is connected to this pressing member, while the other end portion of the cable is guided toward the heel portion of the outer shell and connected to a tight-fastening means attached to a rear cuff. Pulling force is applied to the cable by tightening the fastening means, thereby causing the pressing member connected to the cable to be pressed against the front portion of the ankle of the inner boot member, and thus allowing the whole of the skier's foot to be snugly secured to the shell body.

The foot tightening mechanism of the ski boot described in the second prior art is arranged such that first ends of a pair of tightening belts are rigidly secured to respective positions on the shell body which respectively face the inner and outer heel portions of the skier's foot, while second end portions of the tightening belts are in crossing relationship on the front portion of the ankle and then led outwardly of the outer shell at respective positions which confront the rear portion of the ankle; said second portions are connected to, and tightened by means of, a buckle, thereby securing the foot in the shell body.

The ski boot according to the first prior art has the advantage that, since the pressing member is disposed at the front portion of the ankle, the instep portion including said ankle front portion can effectively be held. However, the entirety of the ankle portion cannot satisfactorily be held, and therefore the ankle portion cannot effectively be fitted to, and held by, the ski boot, which causes adverse effects on the controllability of the ski, for example, edging, and also causes the ankle to easily fatigue.

In the ski boot according to the second prior art, the ankle portion is wound with the tightening bands and therefore held thereby effectively, but the instep portion is not satisfactorily held. Accordingly, the instep portion cannot effectively be fitted to, and held by, the ski boot, which causes, in the same manner as in the case of the first prior art, adverse effects on the controlling of the ski, for example, edging, and also causes the skier's foot to fatigue easily.

It is a primary object of the present invention to provide a ski boot so designed that the entirety of the skier's foot, including the instep and ankle portions, is effectively held by the boot to improve the controllability of the ski, for example, edging.

DESCRIPTION OF PRACTICAL EMBODIMENTS

A first embodiment of the present invention will be described hereinunder with reference to FIGS. 1 and 2.

Figure 1:
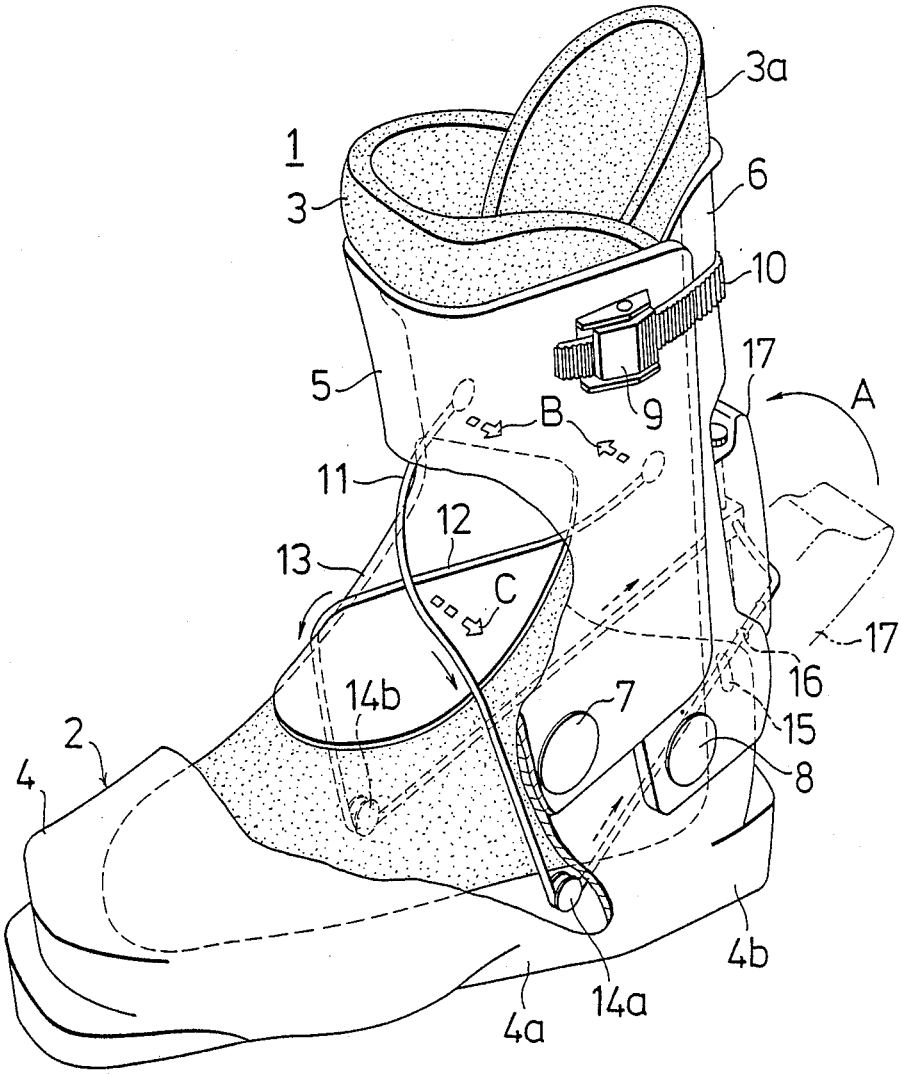
FIG. 1 is a partially-cutaway generally perspective view of a ski boot constructed in accordance with and embodying the present invention.
Figure 2:
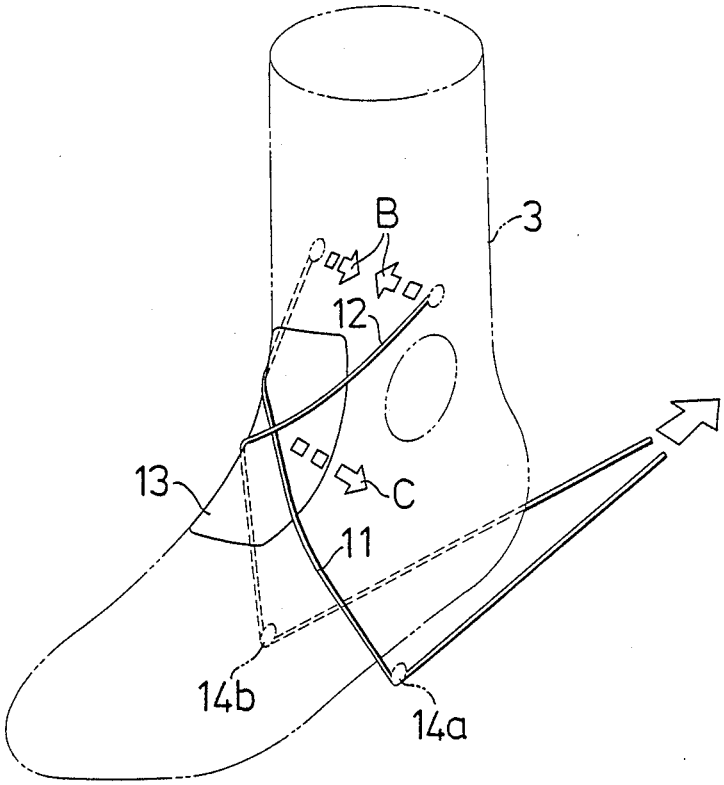
FIG. 2 is a generally perspective substantially schematic view illustrating the relationship of the inner boot, as shown in phantom lines, and the tightening cables.

Referring to FIG. 1, a ski boot generally denoted by the reference numeral 1 broadly comprises an outer shell 2 formed of a rigid and tough synthetic resin material and an inner boot member 3 which is fitted in the outer shell 2.

The outer shell 2 consists of a shell body 4 which mainly covers the wearer's ankle and portions below it, a front cuff 5 which covers the part of the leg which extends from the front portion of the ankle to the lower portion of the calf, and a rear cuff 6 which covers the part of the leg which extends from the upper portion of the heel to the lower portion of the calf. The lower ends of front and rear cuffs 5 and 6 are attached to the inner and outer heel portions of shell body 4 by means of pins 7 and 8 so that cuffs 5 and 6 are enabled to pivot backwardly and forwardly. The rear portion 3*a* of inner boot member 3 which is superposed on rear cuff 6 is able to be opened and closed unitarily with rear cuff 6.

A buckle 9 for tightening is rigidly secured to one side surface of the upper portion of front cuff 5. One end of a tightening band 10 is rigidly secured to the one side surface of front cuff 5. The other or free end portion of band 10 extends about the outer periphery of rear cuff 6 for connection to buckle 9, thereby causing front and rear cuffs 5 and 6 to be tightened in one unit.

In FIG. 1, reference numerals 11 and 12 denote cables for entirely holding the ankle, instep, heel and other portions of the skier's foot. First ends of cables 11 and 12 are rigidly secured to the right and left inner surfaces, respectively, of front cuff 5 in the approximately central portion thereof as viewed in the vertical direction. Second end portions of the cables 11 and 12 mutually cross each other on the instep portion of inner boot member 3 where a pressing pad 13 is disposed, and are then led toward the bottom 4*a* of shell body 4 along the outer surface of inner boot member 3 so as to be engaged with respective guide elements 14*a* and 14*b* which are provided on opposite sides, respectively, of a portion of shell body bottom 4*a* which is closer to the heel of shell body 4. Cables 11 and 12 which are respectively engaged with the cable guide elements 14*a* and 14*b* are hence directed toward a heel cover portion 4*b* of shell body 4, and passed through respective slots 15 provided in heel cover portion 4*b*, and then led outwardly of rear cuff 6 through respective through-holes 16 provided in rear cuff 6. The end portions of cables 11 and 12 which are led outwardly of rear cuff 6 are connected to a fastener or tight-fastening means 17 of conventional character.

In actual use of the ski boot as described above, the skier's foot is inserted into inner boot member 3, and the upper portions of front and rear cuffs 5 and 6 are tightened by means of tightening band 10 and the buckle 9. Then cables 11 and 12 are pulled tightly to cause the skier's foot, together with inner boot member 3, to be secured to outer shell 2. In such case, the fastener or tight-fastening means 17 which is in released position, as shown by the two-dot chain line in FIG. 1, is pivoted in the direction of the arrow A in FIG. 1 into operative position as shown by the solid line in FIG. 1. In consequence, cables 11 and 12 are pulled in the directions of the arrows shown in FIG. 1, and as a result, the ankle portion is subjected to holding forces which act toward each other, as indicated by arrows B in FIGS. 1 and 2, thus enabling the ankle portion to be effectively held. In addition, the instep portion, where cables 11 and 12 cross each other, is subjected to a force which presses the entirety of the foot toward the heel portion as indicated by arrows C in FIGS. 1 and 2, so that both the instep and heel portions are satisfactorily fitted to, and effectively held by, the ski boot.

Accordingly, the skier's foot is free of play within the boot, which means that the foot can be secured to the boot in a snug unitary manner, and satisfactorily fitted thereto; such providing substantial improvements in the ability for control of the ski, for example, edging. Since cables 11 and 12 interact on the instep portion and are pulled in this state, the pulling force does not concentrate on the instep portion but is dispersed throughout the entire instep portion and, in addition, there is no danger of cables 11 and 12 causing the foot to suffer pain. The improvement in the effectiveness of the ski boot in holding the instep, ankle and heel portions of the skier's foot reduces the level of fatigue of the foot, thus providing a most effective and comfortable ski boot.

It should be noted that, although in the above-described embodiment cables 11 and 12 are turned toward rear cuff 6 by virtue of cable guide elements 14*a* and 14*b*, this arrangement is not necessarily limitating as pivot pins 8 may also be utilized for this purpose. Further, the cable fastener or tight-fastening means 17 may also be provided on heel cover portion 4*b* of shell body 4, and pressing pad 13 may be omitted. In addition, continuous members for tightening the skier's foot are not necessarily limited to cables, as band-like members may also be employed.

As described above, foot tightening continuous members interact on the instep portion, with the first ends of said members being rigidly secured to the right and left inner sides, respectively, of front cuff, while second ends thereof are connected to a fastener or tight-fastening means provided on the rear portion of an outer shell. Accordingly, the whole of the skier's foot, including the instep, ankle, and heel portions, can reliably and effectively be held by a single set of foot tightening continuous members. As a result, the foot is free of play within the boot, and the effectiveness of the boot in fitting to the entire foot is therefore improved, thus enabling improvements in the controlling of the ski, for example, edging.

Figure 3:
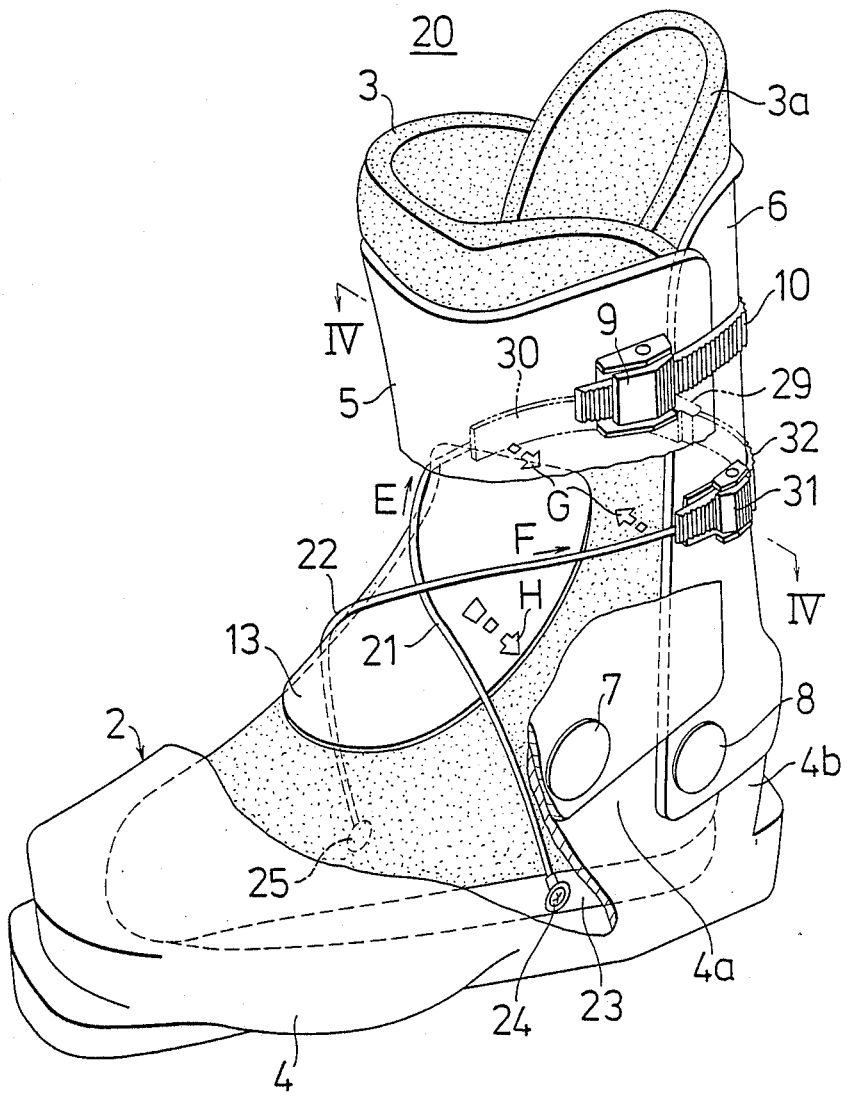
FIG. 3 is a partially-cutaway generally perspective view of a second embodiment of a ski boot constructed in accordance with and embodying the present invention.

FIG. 3 illustrates a second embodiment of the present invention, in which the ski boot is generally denoted by reference numeral 20. Since outer shell 2 and inner boot member 3 which is inserted thereinto are the same as those in the above-described first embodiment, description thereof is omitted. The same constituent elements or portions as those in the first embodiment are denoted by the same reference numerals, and description thereof is omitted.

Figure 4:
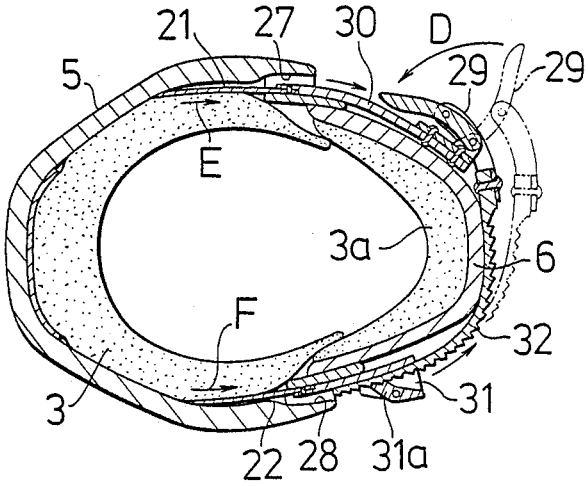
FIG. 4 is a horizontal transverse sectional view taken on the line IV—IV of FIG. 3.

Referring to FIG. 3, reference numerals 21 and 22 denote a pair of cables for holding the entirety of the ankle, instep, and heel portions and adjacent portion of the lower leg. First ends of cables 21 and 22 are disposed on the right and left sides, respectively, of an insole 23 at a position which is closer to the forward end of boot 20 than the heel portion; insole 23 being rigidly secured to the bottom of shell body 4, and said first ends of cables 21 and 22 are rigidly secured by respective screws 24 and 25 to said insole 23. Second end portions of cables 21 and 22 are in mutually crossed relationship on the instep portion of inner boot member 3 where a pressing pad 13 is disposed, and thence guided rearwardly along the side peripheral portions of the ankle and led outwardly of front cuff from respective through-holes 27 and 28 provided in the right and left side portions, respectively, of front cuff 5 which confront the respective sides of the ankle portion, as shown in FIG. 4. The second end of cable 21 is connected to one end of a flexible band 30 which is, in turn, connected to one end of a fastener or tight-fastening member 29 disposed for extension over the outer periphery of the ankle portion of rear cuff 6. The second end of cable 22 is connected to one end of a length adjuster 31. The length adjuster 31 and the fastener or tight-fastening member 29 are disengageably connected to each other by the serrated length of an adjuting band 32 which is connected to the other end of fastener or tight-fastening member 29.

To secure the ski boot of this second embodiment, as described above, to the skier's foot, his foot is first inserted into inner boot member 3, and the upper portions of front and rear cuffs 5 and 6 are tightened by means of tightening band 10 and buckle 9. Thereafter, fastener or tight-fastening member 29, is disposed in inoperative or loosened position, shown by the two-dot chain line in FIG. 4, and length adjusting band 32 is inserted into length adjuster 31. Then, a pawl member 31*a* of length adjuster 31 is engaged with the serrations of band 32, thereby connecting them together. Next, the fastener or tight-fastening member 29, which is in the state shown by the two-dot chain line, is pivoted in the direction of the arrow D in FIG. 4 so as to be set in operative, tightening state, as shown by the solid line in FIG. 4. In consequence, cables 21 and 22 are pulled in the directions of the arrows of E and F, respectively, shown in FIGS. 3 and 4, and, at the same time, the ankle portion is subjected to holding forces which act toward each other as shown by the arrows G in FIG. 3, thus enabling the ankle portion to be effectively held. In addition, the instep portion where cables 21 and 22 cross each other is subjected to a force which presses the whole of the skier's foot toward the heel portion as shown by the arrows H in FIG. 3. Accordingly, the entirety of the foot, including the instep and ankle portions, is uniformly held tightly within the ski boot, and such permits the skier's foot to be satisfactorily fitted to, and effectively held by, the ski boot.

Accordingly, the skier's foot is free of play within the boot, which means that the foot is effectively secured unitarily therewith and satisfactorily fitted thereto; and such provides substantial improvement in the control of the ski, for example, edging. Since cables 21 and 22 are mutually crossed on the instep portion and pulled in this state, the applied force does not concentrate on the instep portion but is dispersed throughout the entirety of the instep portion and, in addition, there is no danger of cables 21 and 22 causing the foot to suffer pain. The improvement in the capability of the ski boot to fit to the instep, ankle, and heel portions of the foot eliminates any unfavorable load on the skier's foot when he controls the ski, which means that the foot fatigue is reduced and it is therefore possible to enjoy pleasant skiing.

Figure 5:
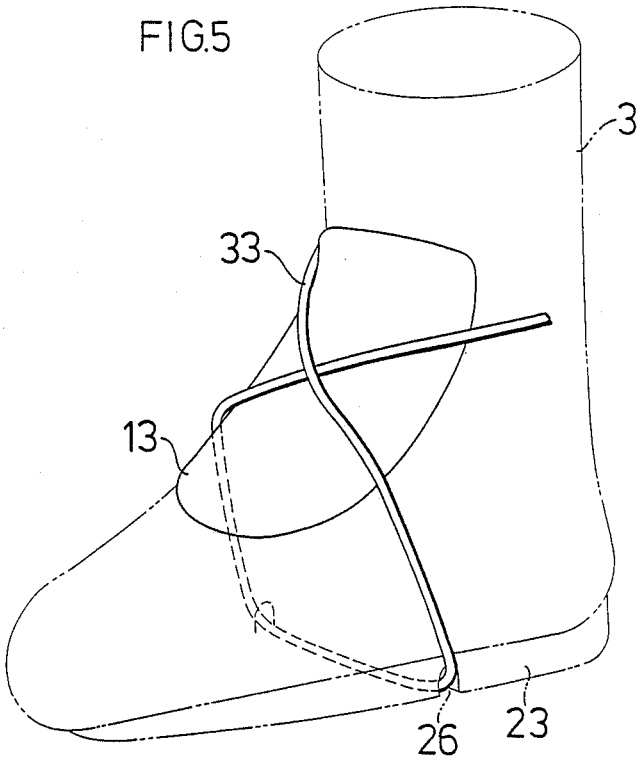
FIG. 5 is a generally perspective substantially schematic view illustrating the relationship of the inner boot, as shown in phantom lines, and the tightening cables of the ski boot shown in FIG. 3.

FIG. 5 shows a modification of the ski boot shown in FIG. 3. This alternative form differs therefrom in that a single cable 33 is employed to tighten the instep and ankle portions of the skier's foot. Accordingly, a portion of insole 23, rigidly secured to the inside bottom surface of the shell body, which confronts the instep portion is provided with a recess 26 which extends transversely therethrough from one side to the other, and cable 33 is passed through said recess 26. The end portions of cable 33 are divided upwardly and are in mutually crossed relationship on the instep portion of inner boot member 3 and then directed rearwardly for connection to fastener or tight-fastening member 29 and length adjuster 31 in the same manner as in the case of the embodiment shown in FIG. 3.

It is a matter of course that this last described modification also provides advantages similar to those offered by the embodiment shown in FIGS. 3 and 4.

It should be noted that, in the arrangements shown in FIGS. 3 and 5, the mechanism for applying tightening force to the cables or foot tightening continuous member(s) is not necessarily limited to the combination of the fastener or fastening member 29 and length adjuster 31 such as that shown in the above-described embodiments.

As described above, according to said second embodiment, foot tightening continuous members as cables 21, 22, or 33 are crossed on the instep portion, and first ends of the continuous members are rigidly secured to the right and left inner sides, respectively, of a front cuff, while second ends of the continuous members are passed along the side portions of the ankle and led outwardly to the rear side of the ankle and connected to a fastener or foot tight-fastening mechanism. Accordingly, the whole of the skier's foot, including the instep, ankle, and heel portions, can reliably and effectively be held by a single set of foot tightening continuous members in such a manner that the ski boot is uniformly and satisfactorily fitted to the foot. As a result, the foot is free of play within the boot, and the effectiveness of the boot in fitting to the whole of the foot is therefore improved, so that it is possible to further improve the controllability of the ski, for example, edging.

Figure 7:
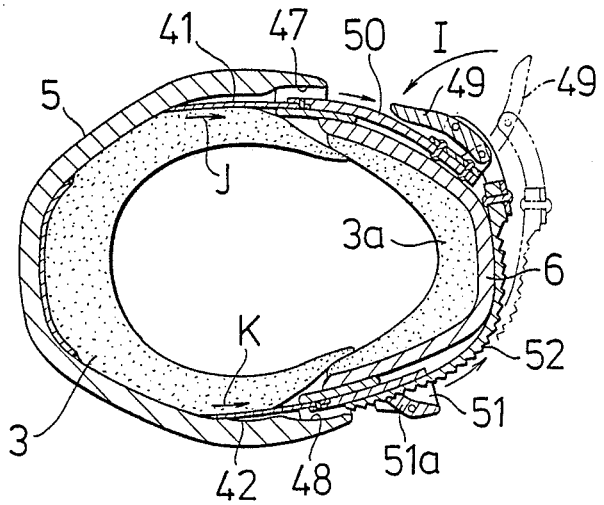
FIG. 7 is a horizontal transverse sectional view taken on the line VII—VII of FIG. 6.
Figure 6:
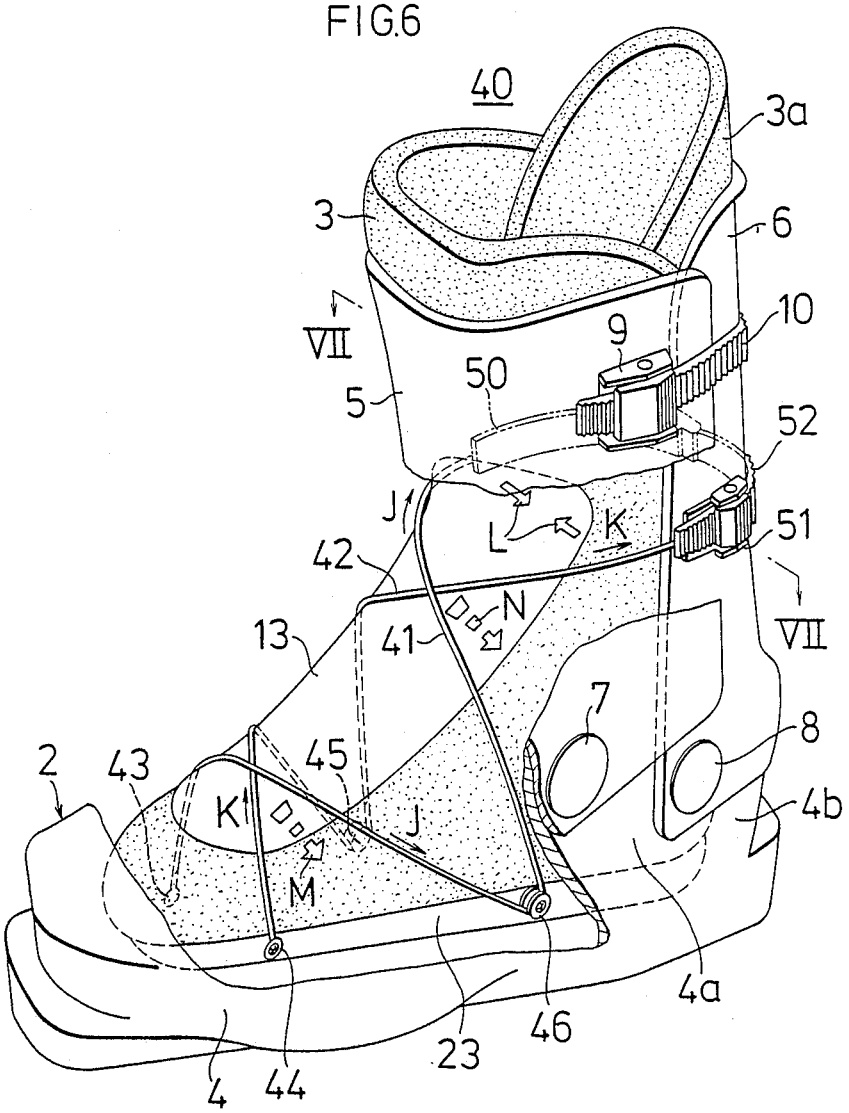
FIG. 6 is a partially-cutaway generally perspective view of a third embodiment of a ski boot constructed in accordance with and embodying the present invention.

Referring to FIGS. 6 and 7, which show in combination an additional or third embodiment of a ski boot designated 40 is constructed according to the present invention. Since outer shell 2 and inner boot member 3 which is inserted thereto are the same as those described in the first embodiment, description thereof is omitted. The same constituent elements or portions as those in the first embodiment are denoted by the same reference numerals.

Referring to FIG. 6, reference numerals 41 and 42 denote a pair of cables for holding the lower leg, together with the ankle, instep, and heel portions. Forward or first ends of cables 41 and 42 are disposed on the right and left sides, respectively, of an insole 23 at a position which is proximate the toe; insole 23 being rigidly secured to the bottom of shell body 4, and said forward or ends of cables 41 and 42 are rigidly secured thereto by respective screws 43 and 44. Second end portions of cables 41 and 42 are disposed on the upper side of pressing pad 13 which is superposed on inner boot member 3 so as to cover the toe and instep portions thereof in such a manner that cables 41 and 42 cross each other on the toe portion of inner boot member 3. Cables 41 and 42 are further guided obliquely rearwardly from the toe portion, for training about guide elements 45 and 46, respectively, which are provided on the right and left sides, respectively, of insole 23 and which are positioned slightly closer to the forward to toe end of boot 40 than the rearward or heel portion. From guides 45, 46 cables 41, 42 extend upwardly across the instep portion, in mutually intersecting relation and are then led rearwardly along the side peripheral portions of the ankle and directed outwardly of front cuff 5 through respective through-holes 47 and 48 which are provided in the right and left side portions, respectively, of front cuff 5 which confront the ankle portion, as shown in FIG. 7. The rearward or second end of cable 41 is thus led outwardly of front cuff and is connected to a flexible band 50 which is, in turn, connected to a fastener or tight-fastening member 49 disposed so as to wrap over the outer periphery of the ankle portion of rear cuff 6; and the rearward or second end of cable 42 is connected to a length adjuster 51. Length adjuster 51 and fastener or tight-fastening member 49 are disengageably connected to each other by a serrated portion of adjusting band 52 which is secured to fastener or tight-fastening member 49.

In order to secure ski boot 40 to the skier's foot, his foot is first inserted into inner boot member 3, and the upper portions of front and rear cuffs 5 and 6 are tightened by means of the tightening band 10 and the buckle 9. Thereafter, fastener or tight-fastening member 49 is brought into the released position, shown by the two-dot chain line in FIG. 7, and adjusting band 52 is inserted into length adjuster 51. Then, a pawl member **51*a* of length adjuster 51 is engaged with the serrations of band 52, thereby connecting them together. Next, fastener or tight-fastening member 49, which is in the released state shown by the two-dot chain line (FIG. 7), is pivoted in the direction of the arrow I so as to be set in the tightened state shown by solid lines in said FIG. 7. In consequence, cables 41 and 42 are pulled in the directions of the arrows of J and K, respectively, shown in FIGS. 6 and 7, and, at the same time, the ankle portion is subjected to holding forces which act toward each other as shown by the arrows L in FIG. 6, thus enabling the ankle portion to be effectively held. In addition, the toe portion where cables 41 and 42 cross each other is subjected to a force which presses the toe portion toward insole 23 as shown by the arrow M in FIG. 6. Further, the instep portion is subjected to a force which presses the whole of the skier's foot toward the heel portion as shown by the arrow N in FIG. 6. Accordingly, the whole of the foot, including the instep and ankle portions, is uniformly fastened tight within the ski boot, and this enables the skier's foot to be satisfactorily fitted to, and effectively held by, ski boot 40 without increasing the strength of the tightening force applied by means of fastener or tight-fastening member 49 and bands 50, 52**.

Accordingly, the skier's foot is free of play within boot 40, which means that the foot can be secured to the boot in one unit and satisfactorily fitted thereto, and this produces further improvements in the controllability of the ski, for example, edging. Since cables 41 and 42 cross each other on the toe and instep portions and are pulled while in this state, the pulling force does not concentrate on the toe and instep portions but is dispersed throughout the whole of the toe and instep portions and, in addition, there is no danger of cables 41 and 42 causing the foot to suffer pain. The improvement in the capability of ski boot 40 to fit to the toe, instep, ankle, and heel portions of the foot eliminates any unfavorable load on the skier's foot when he controls the ski, which means that the foot fatigue is reduced and it is therefore possible to enjoy pleasant and comfortable skiing.

Figure 8:
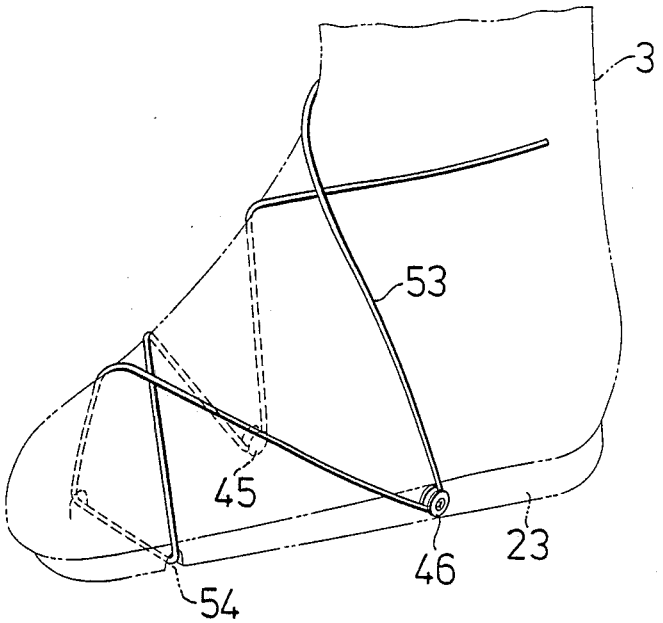
FIG. 8 is a generally perspective generally schematic view of a fourth embodiment of the present invention illustrating the relationship of the tightening cables to the related portions of the boot.

FIG. 8 illustrates a still further or fourth embodiment of a ski boot constructed according to the present invention. This embodiment differs from the above-described third embodiment in that a single cable 53 is employed to tighten the toe, instep, and ankle portions of the skier's foot. Accordingly, a portion of the insole 23, rigidly secured to the bottom inside portion of the shell body, which is adjacent the toe portion thereof is provided with a downwardly opening recess or hole 54 extending transversely on said insole 23 for extension therethrough of a cable 53. From the ends of recess 54 the end portions of cable 53 are directed upwardly over the upper surface of the toe portion of the inner boot member 3, where said end portions are mutually intersected and then continued downwardly and rearwardly for disposition about guide members 45 and 46. From said members 45, 46, the opposed cable portions are led upwardly over the instep portion in crossing relationship, and then connected to the tight-fastening member 49 and the length adjuster 51 in the same manner as in the case of the embodiment shown in FIG. 6.

It is apparent that this embodiment as described also provides advantages similar to those attained by the above-described third embodiment.

Figure 9:
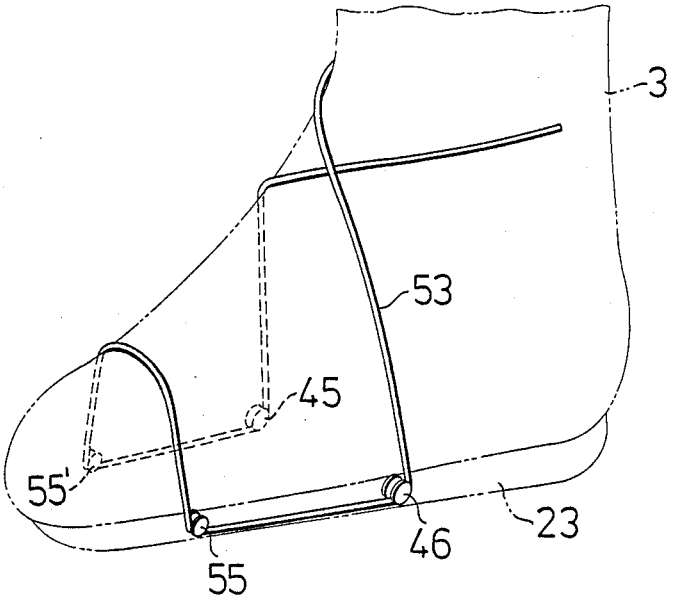
FIG. 9 is a generally perspective generally schematic view of a fifth embodiment of the present invention illustrating the relationship of the tightening cables to the related portions of the boot.

FIG. 9 shows a still further or fifth embodiment of the cable-fastened type ski boot constructed according to the present invention, but differs from the above-described third and fourth embodiments in that guide members 55 and 55' are provided on both sides, respectively, of the toe portion of insole 23, while the substantially central portion of single cable 53 is wrapped over the toe portion of inner boot member 3, and both end portions of cable 53 are successively engaged with the guide members 55, 55' and 45, 46, being in mutually crossing and intersecting relationship on the toe and the instep portions and thence connected to the tight-fastening member 49 and the length adjuster 51, respectively, in the same manner as in the case of the embodiment shown in FIG. 6.

The embodiment as shown in FIG. 9 as described also provides advantages similar to those provided by the embodiment illustrated in FIG. 6.

Figure 10:
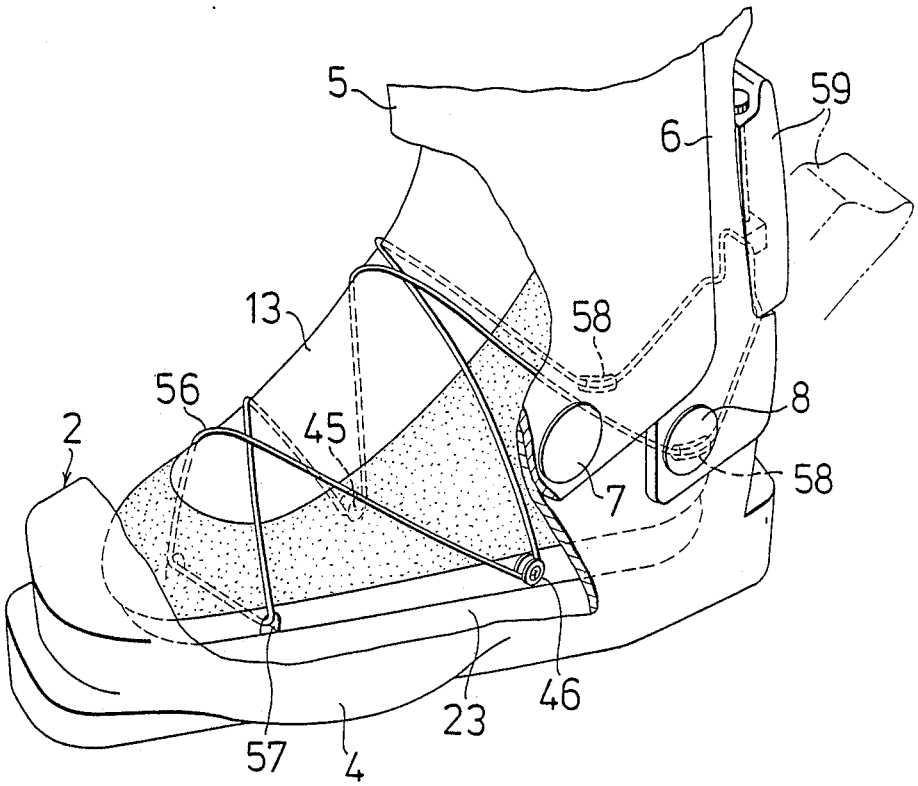
FIG. 10 is a fragmentary, partially cutaway, generally perspective view of a sixth embodiment of a ski boot constructed in accordance with and embodying the present invention.

Referring next to FIG. 10, there is shown another or a sixth embodiment of the ski boot according to the present invention, wherein a single cable 56 is employed, and the intermediate portion of cable 56 is passed through a recess or hole 57 extending throughout the transverse extent of the toe portion of insole 23. The end portions of cable 56 are in mutually crossing relationship on the upper surface of the toe portion of inner boot member 3, and are thence engaged with the ankle-side guide members 45 and 46, from which the same are directed upwardly on the upper surface of the instep portion of the inner boot member 3, in mutually intersecting relation, and are then guided obliquely toward the ankle portion. The end portions of cable 56 are then passed through through-holes 58 which are diametrally provided in pivot pins 8 on opposite sides of rear cuff 6, and then are connected to tight-fastening means 59 which is mounted on the rear portion of rear cuff 6. It should be noted that the same reference numerals as those shown in FIG. 6 denote the same members or portions.

Although the embodiment having the above-described arrangement (FIG. 10) differs from the embodiment shown in FIG. 6 in terms of the cable tight-fastening mechanism and the way in which the ankle portion is held, it is manifest that this embodiment also provides the advantages substantially similar to those obtained by the embodiment shown in FIG. 6.

As has been described above, according to the third to sixth embodiments, a continuous member(s) for tightening the foot is successively wrapped over the toe and instep portions of the foot, and with, one end portion of the continuous member being led outwardly to the rear side of the shell body and connected to a foot tight-fastening mechanism, thereby allowing the skier's foot to be reliably and effectively tightened by means of the foot-tightening continuous member. Accordingly, the whole of the foot, including the toe, instep, ankle, and heel portions, can uniformly be tightened by a single continuous member or a single set of continuous members. As a result, the whole of the foot can be uniformly fitted and reliably as well as effectively held by the ski boot without the need to increase the degree of tightening force applied by the tight-fastening mechanism. There is no danger of the foot suffering pain, and the foot is free of play within the boot, which enables further improvements in the controllability of the ski, for example, edging.

What is claimed is:

1. A ski boot having an outer shell containing a front cuff having opposed side portions, a rear cuff, and an inner boot, having an instep portion, fitted within said outer shell wherein the improvement comprises at least one elongated continuous flexible member having first and second end portions, means engaging said elongated member between its ends for guiding same into crossing relationship on the inner boot instep portion, boot fastening means provided on the rear portion of the outer shell, said first and second end portions of said elongated member being connected to said fastening means.

2. A ski boot as defined in claim 1 wherein said elongated member is a cable.

3. A ski boot as defined in claim 1 wherein said elongated member is of band-forming character.

4. A ski boot as defined in claim 1 wherein an insole is secured to said inner boot, and said means engaging said elongated member is a downwardly opening recess extending transversely across said insole from side to side thereof.

5. A ski boot as defined in claim 1 wherein an insole is secured to said inner boot, and said means engaging said elongated member are guide elements provided on opposite sides of said inner sole.

6. A ski boot having an outer shell containing a front cuff having opposed side portions, a rear cuff, and an inner boot, having an instep portion, fitted within said outer shell wherein the improvement comprises first and second elongated continuous flexible members each having forward and rearward end portions, means fixedly securing the forward ends of said first and second members to said boot, said first and second members being directed in mutually crossing relationship on the instep portion of the inner boot, boot fastening means provided on the rear portion of the outer shell, means securing said first and second members in their rearward end portions to said fastening means.

7. The ski boot defined in claim 6 wherein said means fixedly securing the forward end portions of said elongated members are fasteners provided on opposite sides of said inner cuff.

8. The ski boot defined in claim 7 wherein guide means is provided on said boot, said elongated members in their portions downwardly of the zone of mutual crossing and forwardly of said fastening means being led about said guide means.

9. A ski boot as defined in claim 6 wherein an insole is secured to said inner boot, said means fixedly securing the forward end of said elongated members being fasteners provided on opposite side of said insole.

10. A ski boot as defined in claim 9 wherein guide elements are provided on the insole spacedly rearwardly of each fastener.

11. A ski boot a defined in claim 1 wherein the boot fastening means comprises a tight-fastening member and a length adjuster disposed on the rear portion of the outer shell.

12. A ski boot as defined in claim 6 wherein an insole is secured for said inner boot, said means fixedly securing the forward ends of said elongated members being fasteners provided on opposite side of said insole.

13. A ski boot as defined in claim 10 wherein the elongated members are disposed for extending from said fasteners in crossing relationship over the forward portion of the inner boot, thence rearwardly about guide elements, thence in crossing relationship over the instep portion of the inner boot, thence rearwardly for securement to said boot fastening means.

14. A ski boot having an outer shell with a bottom portion and a heel portion and containing a front cuff having opposed side portions with inner and outer surfaces, a rear cuff, and an inner boot, having an instep portion, fitted within said outer shell wherein the improvement comprises first and second elongated flexible members each having a forward end and a rearward end, the forward ends of said first and second members being fixedly secured in aligned relationship on opposite sides of the inner surface of said front cuff approximately centrally thereof, said first and second members being directed, from said forward end securement, downwardly and forwardly in mutually crossing relationship on the instep portion of the inner boot and thence laterally and downwardly, opposed guide elements secured on the inner side surface of the shell bottom, said first and second members, being trained about the proximate guide element for direction rearwardly and upwardly therefrom toward said shell heel portion, said heel portion having laterally opposed apertures, said rear cuff in the lower portion thereof having laterally opposed openings each located outwardly of the proximate heel portion aperture, said first and second members being lead through the proximate heel portion aperture and rear cuff opening, fastening means provided on the rear portion of said shell and the rearward ends of said first and second members being engaged to said fastening means.

15. A ski boot having an outer shell containing a front cuff having opposed side portions, a rear cuff, and an inner boot, having an instep portion, fitted within said outer shell wherein the improvement comprises first and second elongated continuous flexible members each having forward and rearward end portions, means fixedly securing the forward ends of said first and second members to said shell substantially intermediate the height thereof, said first and second members being directed downwardly and forwardly in mutually crossing relationship on the instep portion of the inner boot, boot fastening means provided on the rear portion of the outer shell, means securing said first and second members in their rearward end portions to said fastening means, there being first guide elements provided on said shell downwardly and laterally of said inner boot instep portion on opposite sides thereof, second guide means located between each first guide element and said boot fastening means, said members being each directed by the related first guide element and second guide means from said instep portion to said fastener means.

16. A ski boot as defined in claim 14 or 15 wherein said elongated members are cables.

17. A ski boot as defined in claims 14 or 15 wherein said elongated members are of band-forming character.

* * * * *